US006973392B2

(12) United States Patent
Zeh et al.

(10) Patent No.: US 6,973,392 B2
(45) Date of Patent: Dec. 6, 2005

(54) METHOD OF DETERMINING THE IMBALANCE OF A LAUNDRY DRUM

(75) Inventors: Stefan Zeh, Wangen (DE); Martin Weinmann, Bad Waldsee (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 0 days.

(21) Appl. No.: 11/040,805

(22) Filed: Jan. 21, 2005

(65) Prior Publication Data

US 2005/0143940 A1 Jun. 30, 2005

Related U.S. Application Data

(63) Continuation of application No. PCT/EP03/07388, filed on Jul. 9, 2003.

(30) Foreign Application Priority Data

Jul. 26, 2002 (DE) ..... 102 34 053

(51) Int. Cl.[7] ..... G06F 19/00; D06F 33/00
(52) U.S. Cl. ..... 702/60; 702/64; 68/12.06
(58) Field of Search ..... 702/60, 57, 64, 702/65; 318/599, 53, 452, 453, 454, 455; 68/12.06, 12.16; 8/159

(56) References Cited

U.S. PATENT DOCUMENTS 2,917,175 A 12/1959 Toma
5,070,565 A * 12/1991 Sood et al. ..... 8/159
5,677,606 A * 10/1997 Otake ..... 318/434
6,240,586 B1 * 6/2001 Joo ..... 8/159
6,418,581 B1 * 7/2002 Bruce et al. ..... 8/159
6,564,592 B2 * 5/2003 Bruce et al. ..... 68/12.06
6,640,372 B2 * 11/2003 Ciancimino et al. ..... 8/159
6,642,690 B2 * 11/2003 Kim ..... 318/811
6,715,175 B2 * 4/2004 Ciancimino et al. ..... 8/159
2002/0030462 A1 * 3/2002 Matsushiro et al. ..... 318/727
2003/0056302 A1 * 3/2003 Broker et al. ..... 8/159

FOREIGN PATENT DOCUMENTS

DE 38 22 924 C1 11/1989
DE 41 01 341 A1 7/1992
DE 42 08 989 A1 9/1993
DE 44 31 846 A1 3/1996
DE 199 18 331 A1 10/2000
EP 0 275 862 A2 7/1988

(Continued)

*Primary Examiner*—Patrick J. Assouad
(74) *Attorney, Agent, or Firm*—Laurence A. Greenberg; Werner H. Stemer; Ralph E. Locher

(57) ABSTRACT

Before a washing machine is switched over to a very high spin speed in the spin program of the washing machine, the existing imbalance due to irregular distribution of laundry in the drum should be checked. If the imbalance is too strong, the spin program should be interrupted if there is a threat of excessively high bearing forces to be expected. The fluctuation in rotary speed, which may have a high frequency due to the drum speed, and of the power consumption of the washing machine motor measured downstream of the direct current intermediate circuit prior to the feed thereof into the inverter for producing the rotary field in the motor. There, the vector product of the current and the voltage for imbalance measurement by determining power is blocked off from mains network interference effects by the high capacitance of the direct current intermediate circuit.

7 Claims, 1 Drawing Sheet

FOREIGN PATENT DOCUMENTS

| | | |
|---|---|---|
| EP | 0 313 339 A1 | 4/1989 |
| EP | 1 045 062 A2 | 10/2000 |
| JP | 3 091 511 | 4/1991 |
| JP | 4 314 496 | 11/1992 |

* cited by examiner

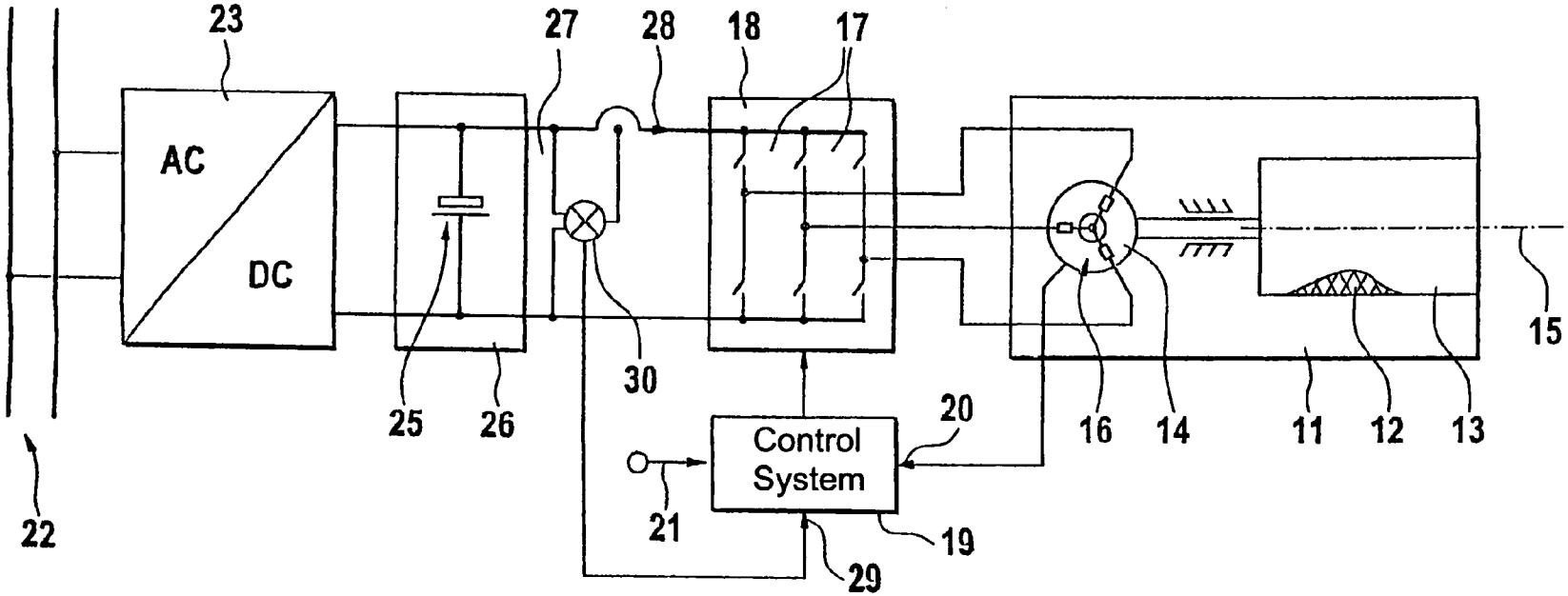
15
13
12
11
14
16
20
19
17
18
Control System
29
28
30
21
27
26
25
23
AC
DC
22

METHOD OF DETERMINING THE IMBALANCE OF A LAUNDRY DRUM

CROSS-REFERENCE TO RELATED APPLICATION

This is a continuing application, under 35 U.S.C. § 120, of copending international application No. PCT/EP03/07388, filed Jul. 9, 2003, which designated the United States; this application also claims the priority, under 35 U.S.C. § 119, of German patent application No. 102 34 053.6, filed Jul. 26, 2002; the prior applications are herewith incorporated by reference in their entirety.

BACKGROUND OF THE INVENTION

Field of the Invention

The invention pertains to a method of determining a characteristic value for the imbalance of a laundry drum of a washing machine. The drum is driven by an electric drive motor about an at least approximately horizontal axis. The characteristic value is determined by measuring the periodic fluctuation in the electrical power consumption (dP/dt) of its drive motor.

A method of that kind is known from European published patent application EP 1 045 062 A2 and U.S. Pat. No. 6,240,586 B1. There, the power consumption, which fluctuates in relation to time according to drum rotation, of the drive motor from the mains network is used as the measurement in respect of imbalance, with hard rotary speed regulation, that is to say at a rotary speed which is as constant as possible. It has been found however that the fluctuations, which in practice are slight, in the mains network power drawn are very difficult to reproducibly detect in terms of a measuring procedure because, besides the mains network frequency which in any case already cause interference, the voltage and current measuring procedures—particularly when the situation involves a comparatively high level of power consumption because the laundry drum is well filled—have still further interference influences superimposed thereon, and those influences make evaluation of the measurement result which is actually of interest anything from uncertain to impossible.

The prior art method of evaluating the imbalance of a loaded washing machine drum therefore involves measuring the rotary speed fluctuation caused by the imbalance in the course of a revolution, with soft rotary speed regulation to a relatively low drum speed. It will be noted however that there is the disadvantage here that, with a high degree of drum filling, as a consequence of a correspondingly increased mass moment of inertia and at a relatively high nominal rotary speed, the fluctuations in rotary speed which occur around the nominal rotary speed become so slight that they can scarcely still be detected in terms of the measuring procedure involved.

On the other hand there is a need for imbalance measurement when a relatively high spin speed is involved because modern washing machines spin at such high speeds that, as a precaution, before making the transition into the highest spin speed, the imbalance of the drum, which prevails at the current time, with the laundry filling which has already begun to be spun, should be checked once again in order to avoid operating conditions which are dangerous in dependence on drum loading, when the machine makes the transition to the highest spin speed, that is to say, in order if necessary to avoid switching to the highest possible spin speed.

SUMMARY OF THE INVENTION

It is accordingly an object of the invention to provide a method of determining the imbalance of a laundry drum which overcomes the above-mentioned disadvantages of the heretofore-known devices and methods of this general type and which provides for a method that promises informative and reproducible measurement values in respect of drum imbalance directly prior to the transition from high to very high drum speeds.

With the foregoing and other objects in view there is provided, in accordance with the invention, a method of determining a characteristic value for an imbalance of a laundry drum that is electrically driven about a substantially horizontal axis. The method comprises the following:

measuring a periodic fluctuation in an electrical power consumption of a drive motor, and thereby measuring the electrical power consumption between a direct current intermediate circuit and a controlled inverter for impressing a rotary field into the drive motor.

In other words, the objects of the invention are achieved in that the direct current consumption of the motor in the circuit from the direct current intermediate circuit to the inverter is taken as the basis, directly from a high drum speed, with hard rotary speed regulation, that is to say a constant rotary speed. That direct current measurement result is well blocked off in relation to the mains network as a consequence of the rectifier circuit upstream of the direct current intermediate circuit, that is to say interference phenomena at the network side are practically no longer superimposed on that direct current measurement result, and that therefore also permits reproducible measurement of very small temporal fluctuations in the motor power which is drawn in dependence on imbalance.

In accordance with an added feature of the invention, the product of a d.c. voltage at the output of the direct current intermediate circuit and direct current from the direct current intermediate circuit into the inverter is determined in a power measuring circuit.

In accordance with an additional feature of the invention, only the degree of the periodic fluctuation in the direct current drawn by the motor from the direct current intermediate circuit by way of the inverter is detected as proportional to the drawn electrical d.c. power at a constant d.c. voltage.

In accordance with another feature of the invention, the current fluctuation is detected at a temporarily raised voltage. It is advantageous if the voltage is raised to mains network voltage.

In accordance with a concomitant feature of the invention, the power or current measurement is effected in the spin mode at an elevated drum speed prior to a possible transition to a maximum drum speed.

Before a washing machine is switched over to a very high spin speed in the spin program of the washing machine, the existing imbalance on the basis of irregular distribution of laundry in the drum should be checked once again from the instantaneous spin speed and possibly the spin program should be broken off if there is a threat of excessively high bearing forces occurring. Because the fluctuation in rotary speed in the course of a revolution with a high mass inertia, as a consequence of a high drum loading, is scarcely still measurable and recording of the periodic fluctuation in the ac power taken by the drum drive from the domestic mains network is dominatingly superimposed by the mains network frequency and other network interference influences, the fluctuation, which is at high frequency in dependence on drum speed, of the power consumption of the washing machine motor is implemented downstream of the direct current intermediate circuit prior to the feed thereof into the inverter for producing the rotary field in the motor, where product formation from the current and the voltage for imbalance measurement by determining power is blocked off in relation to mains network interference effects by the high capacitance of the direct current intermediate circuit.

Other features which are considered as characteristic for the invention are set forth in the appended claims.

Although the invention is illustrated and described herein as embodied in a method of determining the imbalance of a laundry drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The single FIGURE of the drawing is a partly schematic partly diagrammatic view illustrating the location of power measurement in the course of supplying a drive motor for a laundry drum which is subject to imbalance.

DESCRIPTION OF THE PREFERRED EMBODIMENTS

Referring now to the sole FIGURE of the drawing in detail, washing machine 11 is equipped for treating laundry 12 in its washing solution tank with a perforated drum 13. The drum 13 can in this case be driven in rotation by a rotating field motor 14 about a substantially horizontal axis 15. The rotating field for that purpose is impressed on the motor 14 by way of alternately passing current through typically three stator winding systems 16 which are each connected to a half-bridge circuit 17 for switching and pole changing of a stator magnetomotive force. The entirety of the bridge circuits 17 therefore acts as an inverted rectifier or inverter 18, whose switching sections are cyclically switched by a general control system 19 for predetermining the direction and speed of rotation of the drum drive motor 14. The control system 19 operates as a rotary speed regulator if the actual rotary speed 20 is fed back thereto in order to compare it to a reference rotary speed 21 which is predetermined manually or from a washing program.

The feed to the washing machine motor 14 and thus the inverter 18 connected upstream thereof is implemented from the alternating current domestic mains network 22 (a.c. mains) by way of a converter 23 with a rectifier circuit which is buffered towards the load by a large capacitor 25 of a so-called direct current intermediate circuit 26.

If the drum 13 which is rotated by the motor 14 is operated with an imbalance in the form of laundry 12 which is distributed eccentrically, that is to say unequally around the drum periphery, then the consequence of this, when the drum 11 rotates, is that, during the upward movement of that imbalance, a greater amount of power is taken from the mains network 22 by the motor 11 than in half a revolution further in the downward movement of the imbalance—provided only that such rotation is at sufficiently high speed that the laundry 12, due to the centrifugal force involved, is not allowed to drop back into the drum as it moves upwardly, but is pressed reliably against the drum wall. Thus, that fluctuation in the power dP taken, in relation to time dt, namely in the course of a drum revolution, is a measurement in respect of the instantaneous imbalance of the drum 13 and thus a criterion as to whether a further increase in the drum speed (in particular for effectively removing moisture in the higher-speed spin phase) is permitted or prevented by the control system 19.

In accordance with the invention, however, power measurement is not effected at the connection of the consumer to the alternating current mains network 22 but in the direct current supply of the inverter 18 downstream of the direct current intermediate circuit 26. There, the vector product is formed from the d.c. voltage 27 and the direct current 28 for feeding the motor 14 by way of the inverter 18, and switched to the control system 19, as power 29 which fluctuates in dependence on time. That measurement procedure can also be carried out reproducibly and without interference even at a very high drum speed 13 and with a power consumption that correspondingly fluctuates at high frequency, because any disturbing network influences are reliably kept away from vectorial product formation in the power measuring circuit 30 by the converter 23 and the low pass effect of the direct current intermediate circuit 26.

To simplify that imbalance measuring method which also operates excellently even at a high drum speed, it is even sufficient to measure just the current consumption 28 from the direct current intermediate circuit 26 because by virtue of the storage action of its large capacitance 25 it carries an output d.c. voltage 27 which on average is sufficiently constant and therefore the time-dependent power consumption dP/dt of the washing machine motor 14 is proportional to the prevailing current consumption 28 over all three output phases of the inverter 18.

A development according to the invention that has proven to be particularly advantageous provides that current measurement is effected downstream of the direct current intermediate circuit 26 for determining the imbalance at high drum speeds if the motor voltage 27 in that case is temporarily increased, preferably temporarily switched to the greatest value (that is to say to mains network voltage). For, at relatively high motor voltages and thus a lesser degree of slip, the characteristic of the torque and thus the electrical power P consumed or the motor current 28 falls more steeply in relation to the rotary speed; the fall is correspondingly steeper, the higher the applied motor voltage 27 is. If therefore the rotary speed fluctuates due to imbalance, the resulting fluctuation in the current 28 drawn by the drive motor 14 for the drum 13 occurs to a correspondingly greater degree, the higher that the applied motor voltage 27 is at the time. Thus, the temporary increase in voltage at a high rotary speed results in a marked, reproducibly detectable current fluctuation di/dt in spite of imbalance in the drum loading being only slight—but perhaps nonetheless already being structurally critical, for a further increase in the rotary speed.

Therefore before a washing machine 11 is switched over to a very high spin speed in the course of the spin program of the washing machine, the existing imbalance on the basis of irregular distribution of laundry 12 in the drum 13 should be checked once again from the instantaneous spin speed and possibly the spin program should be broken off if there is a threat of excessively high bearing forces occurring. Because however at a high speed and with a high mass inertia, as a consequence of a high drum loading, the fluctuation in rotary speed in the course of a revolution of the drum 13 is scarcely still measurable and recording of the periodic fluctuation in the a.c. power dP/dt taken by the drum drive 14 from the domestic mains network 22 is dominatingly superimposed by the mains network frequency and other network interference influences, in accordance with the invention the rotary speed-dependent fluctuation in current consumption di/dt of the washing machine motor 14 is implemented from the direct current intermediate circuit 26 prior to the feed into the inverter 18 for producing the rotary field in the motor 14, where the imbalance-dependent current fluctuation di/dt is blocked off in relation to mains network interference effects by the high capacitance 25 of the direct current intermediate circuit 26. That current fluctuation di/dt which is to be measured for determining imbalance at a high rotary speed can be shown still more clearly if it is detected at a motor voltage 27 which is temporarily increased for that purpose.

We claim:

1. A method of determining a characteristic value for an imbalance of a laundry drum electrically driven about a substantially horizontal axis, the method which comprises:

measuring a periodic fluctuation in an electrical power consumption of a drive motor, and thereby measuring the electrical power consumption between a direct current intermediate circuit and a controlled inverter for impressing a rotary field into the drive motor.

2. The method according to claim 1, which comprises determining a product of a d.c. voltage at an output of the direct current intermediate circuit, and a direct current from the direct current intermediate circuit into the inverter, in a power measuring circuit.

3. The method according to claim 1, which comprises detecting only a degree of the periodic fluctuation in the direct current drawn by the drive motor from the direct current intermediate circuit by way of the inverter as proportional to a drawn electrical d.c. power at a constant d.c. voltage.

4. The method according to claim 1, which comprises detecting the current fluctuation at a temporarily raised voltage.

5. The method according to claim 4, which comprises detecting the current fluctuation at a voltage temporarily raised to mains network voltage.

6. The method according to claim 1, which comprises effecting a power or a current measurement in a spin mode of the laundry drum at an elevated drum speed prior to a possible transition to a maximum drum speed.

7. In a washing machine having a laundry drum rotatably driven about a substantially horizontal axis, and an electrical drive with a drive motor energized from an a.c. mains circuit, a direct current intermediate circuit, and a controlled inverter for impressing a rotary field into the drive motor connected between the a.c. mains and the drive motor, a method of determining a characteristic value for an imbalance of the laundry drum, the method which comprises:

measuring a periodic fluctuation in an electrical power consumption of the drive motor, and thereby measuring the electrical power consumption between the direct current intermediate circuit and the controlled inverter for impressing the rotary field into the drive motor.

* * * * *